US009279262B2

(12) United States Patent
Perdue

(10) Patent No.: US 9,279,262 B2
(45) Date of Patent: Mar. 8, 2016

(54) CHIMNEY DEMOLITION VEHICLE

(71) Applicant: International Chimney, Williamsville, NY (US)

(72) Inventor: Joseph S. Perdue, Pendleton, NY (US)

(73) Assignee: International Chimney Corporation, Williamsville, NY (US)

( * ) Notice: Subject to any disclaimer, the term of this patent is extended or adjusted under 35 U.S.C. 154(b) by 212 days.

(21) Appl. No.: 14/100,636

(22) Filed: Dec. 9, 2013

(65) Prior Publication Data

US 2015/0159388 A1 Jun. 11, 2015

(51) Int. Cl.

| | |
|---|---|
| ***E04G 23/08*** | (2006.01) |
| ***E02F 3/96*** | (2006.01) |
| ***E02F 9/02*** | (2006.01) |

(52) U.S. Cl.

CPC ..... *E04G 23/082* (2013.01); *E02F 3/965* (2013.01); *E02F 3/966* (2013.01); *E02F 9/024* (2013.01); *E02F 9/028* (2013.01); *E04G 2023/086* (2013.01); *E04G 2023/087* (2013.01)

(58) Field of Classification Search

CPC ..... E04G 23/082; E04G 2023/087
USPC ..... 299/37.1, 37.3, 37.4, 37.5
See application file for complete search history.

(56) References Cited

U.S. PATENT DOCUMENTS 3,840,128 A * 10/1974 Swoboda, Jr. ..... B25J 9/045 182/2.11
4,955,457 A * 9/1990 Pohl ..... E04G 23/08 182/128
5,653,508 A * 8/1997 Carney ..... E04G 23/08 299/15
7,494,191 B1 * 2/2009 Crites ..... E02D 29/1445 125/13.03

FOREIGN PATENT DOCUMENTS

DE 3512212 A1 * 10/1986 ..... E02F 3/963
WO 2009/118198 10/2009

* cited by examiner

*Primary Examiner* — David Bagnell
*Assistant Examiner* — Michael Goodwin
(74) *Attorney, Agent, or Firm* — Simpson & Simpson, PLLC

(57) ABSTRACT

A demolition apparatus including a main chassis, first and second front arms pivotally connected to the main chassis and comprising first and second wheel assemblies, respectively, a rear telescoping arm fixedly connected to the main chassis and comprising a third wheel assembly, first, second and third boom sections and a telescoping catwalk assembly, the first and second boom sections interconnected by a first hydraulic cylinder and the second and third boom sections interconnected by a second hydraulic cylinder, the first and second hydraulic cylinders comprising first and second resistances to movement, respectively, and, an excavator assembly pivotally connected to the main chassis, wherein the first, second and third wheel assemblies comprise first, second and third hydraulic motors, respectively, the first, second and third hydraulic motors are balanced and adapted to rotate the first, second and third wheel assemblies at a common speed, the first and second hydraulic cylinders are balanced and adapted to selectably extend and retract according to the smaller of the first and second resistances at a time when a pressure change is directed to the first and second cylinders.

20 Claims, 6 Drawing Sheets

CHIMNEY DEMOLITION VEHICLE

FIELD OF THE INVENTION

The invention broadly relates to a demolition device, more specifically to a demolition device for chimney structures, cooling towers, smokestacks, silos, etc., and even more particularly to a demolition device for chimney structures, cooling towers, smokestacks, silos, etc., arranged to level such structures beginning from the upper portion.

BACKGROUND OF THE INVENTION

Methods for demolishing chimneys, cooling towers, smokestacks, silos and the like are well known in the art. Images of explosive based demolition projects are well known. Empirical and scientific data provides the basis of controlled destruction of a variety of structures. Experts in this art are capable of leveling extremely large structures while maintaining the location of where the leveled structure will rest. However, due to various regulations and other constraints such as proximity of adjacent structures, explosive demolition techniques are not always an option.

Apparatus for demolishing the foregoing structures have also been used. For example, International Patent Application Publication No. WO 2009/118198 discloses a device for the demolition of building structures. The device includes at least one power shovel or other wrecking means, a main frame upon which the power shovel is mounted and at least three crossbeams arranged to mount the device on the structure to be demolished wherein at least one of the crossbeams is lengthwise adjustable.

As can be derived from the variety of devices and methods directed at demolition of structures, many means have been contemplated to accomplish the desired end, i.e., cost effective, efficient and safe demolition of a variety of structure types. Heretofore, tradeoffs between cost and performance were required. Thus, there is a long-felt need for a demolition apparatus which can be economically produced and safely used on a variety of structure types.

BRIEF SUMMARY OF THE INVENTION

The present invention broadly comprises a demolition apparatus. The demolition apparatus includes a main chassis, first and second front arms pivotally connected to the main chassis and including first and second wheel assemblies, respectively, a rear telescoping arm fixedly connected to the main chassis and including a third wheel assembly, and an excavator assembly pivotally connected to the main chassis. The first, second and third wheel assemblies include first, second and third hydraulic motors, respectively, the first, second and third hydraulic motors are balanced and adapted to rotate the first, second and third wheel assemblies at a common speed.

In an embodiment, the first, second and third hydraulic motors are balanced by fluid communication between the first, second and third hydraulic motors. In an embodiment, each of the first, second and third wheel assemblies are attached to the first front arm, the second front arm and the rear telescoping arm, respectively, via a combination yoke and spindle assembly, and each combination yoke and spindle assembly is adapted to permit movement of a wheel assembly in a vertical plane and a horizontal plane. In an embodiment, the rear telescoping arm further includes first, second and third boom sections and a telescoping catwalk assembly, the first and second boom sections interconnected by a first hydraulic cylinder and the second and third boom sections interconnected by a second hydraulic cylinder, the first and second hydraulic cylinders include first and second resistances to movement, respectively, the first and second hydraulic cylinders are balanced and adapted to selectably extend and retract according to the smaller of the first and second resistances at a time when a pressure change is directed to the first and second cylinders. In an embodiment, the first and second hydraulic cylinders are balanced by forming a fluid connection between the first and second hydraulic cylinders.

The present invention further broadly comprises a demolition apparatus. The demolition apparatus includes a main chassis, first and second front arms pivotally connected to the main chassis and include first and second wheel assemblies, respectively, a rear telescoping arm fixedly connected to the main chassis and include a third wheel assembly, first, second and third boom sections and a telescoping catwalk assembly, the first and second boom sections interconnected by a first hydraulic cylinder and the second and third boom sections interconnected by a second hydraulic cylinder, the first and second hydraulic cylinders include first and second resistances to movement, respectively, and an excavator assembly pivotally connected to the main chassis. The first and second hydraulic cylinders are balanced and adapted to selectably extend and retract according to the smaller of the first and second resistances at a time when a pressure change is directed to the first and second cylinders.

In an embodiment, the first and second hydraulic cylinders are balanced by forming a fluid connection between the first and second hydraulic cylinders. In an embodiment, the first, second and third wheel assemblies include first, second and third hydraulic motors, respectively, the first, second and third hydraulic motors are balanced and adapted to rotate the first, second and third wheel assemblies at a common speed. In an embodiment, the first, second and third hydraulic motors are balanced by fluid communication between the first, second and third hydraulic motors. In an embodiment, each of the first, second and third wheel assemblies are attached to the first front arm, the second front arm and the rear telescoping arm, respectively, via a combination yoke and spindle assembly, and each combination yoke and spindle assembly is adapted to permit movement of a wheel assembly in a vertical plane and a horizontal plane.

The present invention still yet further broadly comprises a demolition apparatus. The demolition apparatus includes a main chassis, first and second front arms pivotally connected to the main chassis and include first and second wheel assemblies, respectively, a rear telescoping arm fixedly connected to the main chassis and include a third wheel assembly, first, second and third boom sections and a telescoping catwalk assembly, the first and second boom sections interconnected by a first hydraulic cylinder and the second and third boom sections interconnected by a second hydraulic cylinder, the first and second hydraulic cylinders include first and second resistances to movement, respectively, and an excavator assembly pivotally connected to the main chassis. The first, second and third wheel assemblies include first, second and third hydraulic motors, respectively, the first, second and third hydraulic motors are balanced and adapted to rotate the first, second and third wheel assemblies at a common speed, the first and second hydraulic cylinders are balanced and adapted to selectably extend and retract according to the smaller of the first and second resistances at a time when a pressure change is directed to the first and second cylinders.

In an embodiment, the first, second and third hydraulic motors are balanced by fluid communication between the first, second and third hydraulic motors. In an embodiment, each of the first, second and third wheel assemblies are attached to the first front arm, the second front arm and the rear telescoping arm, respectively, via a combination yoke and spindle assembly, and each combination yoke and spindle assembly is adapted to permit movement of a wheel assembly in a vertical plane and a horizontal plane. In an embodiment, the first and second hydraulic cylinders are balanced by forming a fluid connection between the first and second hydraulic cylinders.

The present invention yet further broadly comprises a demolition apparatus including a main chassis, first and second front arms pivotally connected to the main chassis and having first and second wheel assemblies, respectively, a rear arm fixedly connected to the main chassis and having a track and a third wheel assembly adapted for displacement within the track, and an excavator assembly pivotally connected to the main chassis.

In an embodiment, the first, second and third wheel assemblies include first, second and third hydraulic motors, respectively, the first, second and third hydraulic motors are balanced and adapted to rotate the first, second and third wheel assemblies at a common speed. In an embodiment, the first, second and third hydraulic motors are balanced by fluid communication between the first, second and third hydraulic motors. In an embodiment, each of the first, second and third wheel assemblies are attached to the first front arm, the second front arm and the rear arm, respectively, via a combination yoke and spindle assembly, and each combination yoke and spindle assembly is adapted to permit movement of a wheel assembly in a vertical plane and a horizontal plane.

In an embodiment, the rear arm further includes a wheel mount and first and second hydraulic cylinders, the third wheel assembly rotatably secured to the wheel mount, the first hydraulic cylinder connected to the main chassis and the second hydraulic cylinder, the second hydraulic cylinder connected to the first hydraulic cylinder and the wheel mount, the first and second hydraulic cylinders include first and second resistances to movement, respectively, the first and second hydraulic cylinders are balanced and adapted to selectably extend and retract according to the smaller of the first and second resistances at a time when a pressure change is directed to the first and second cylinders. In an embodiment, the first and second hydraulic cylinders are balanced by forming a fluid connection between the first and second hydraulic cylinders. In an embodiment, the third wheel assembly is adapted for linear displacement within the track.

It is a general object of the present invention to provide a demolition apparatus that eliminates the shortcomings of known demolition devices.

It is another general object of the present invention to provide a demolition apparatus that possesses increased safety and performance features over known demolition devices.

These and other objects and advantages of the present invention will be readily appreciable from the following description of preferred embodiments of the invention and from the accompanying drawings and claims.

BRIEF DESCRIPTION OF THE DRAWINGS

The nature and mode of operation of the present invention will now be more fully described in the following detailed description of the invention taken with the accompanying drawing figures, in which.

DETAILED DESCRIPTION OF THE INVENTION

Figure 1:
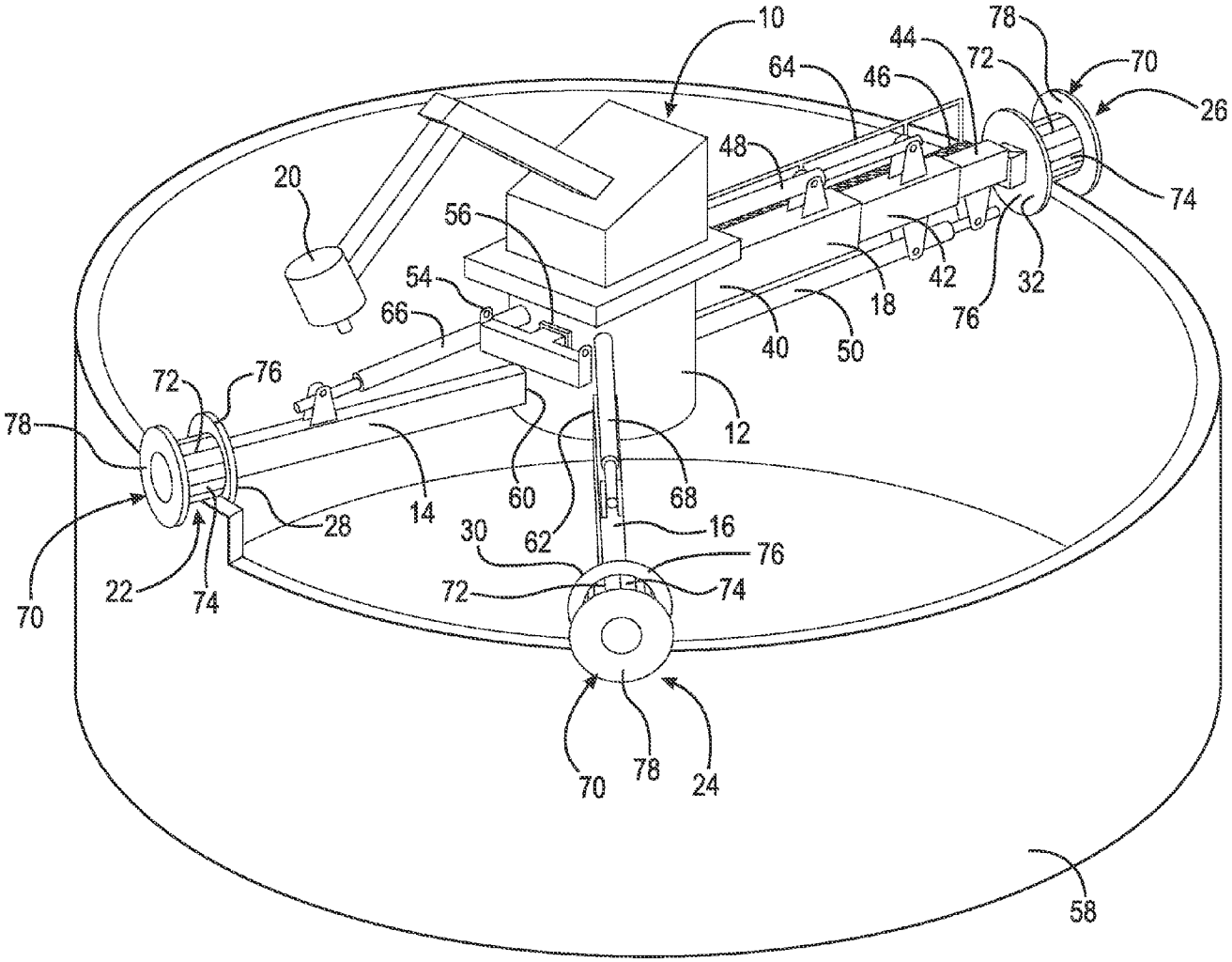
FIG. 1 is a perspective view of a portion of a chimney structure with an embodiment of a present invention demolition apparatus positioned at the top of the chimney.
Figure 2:
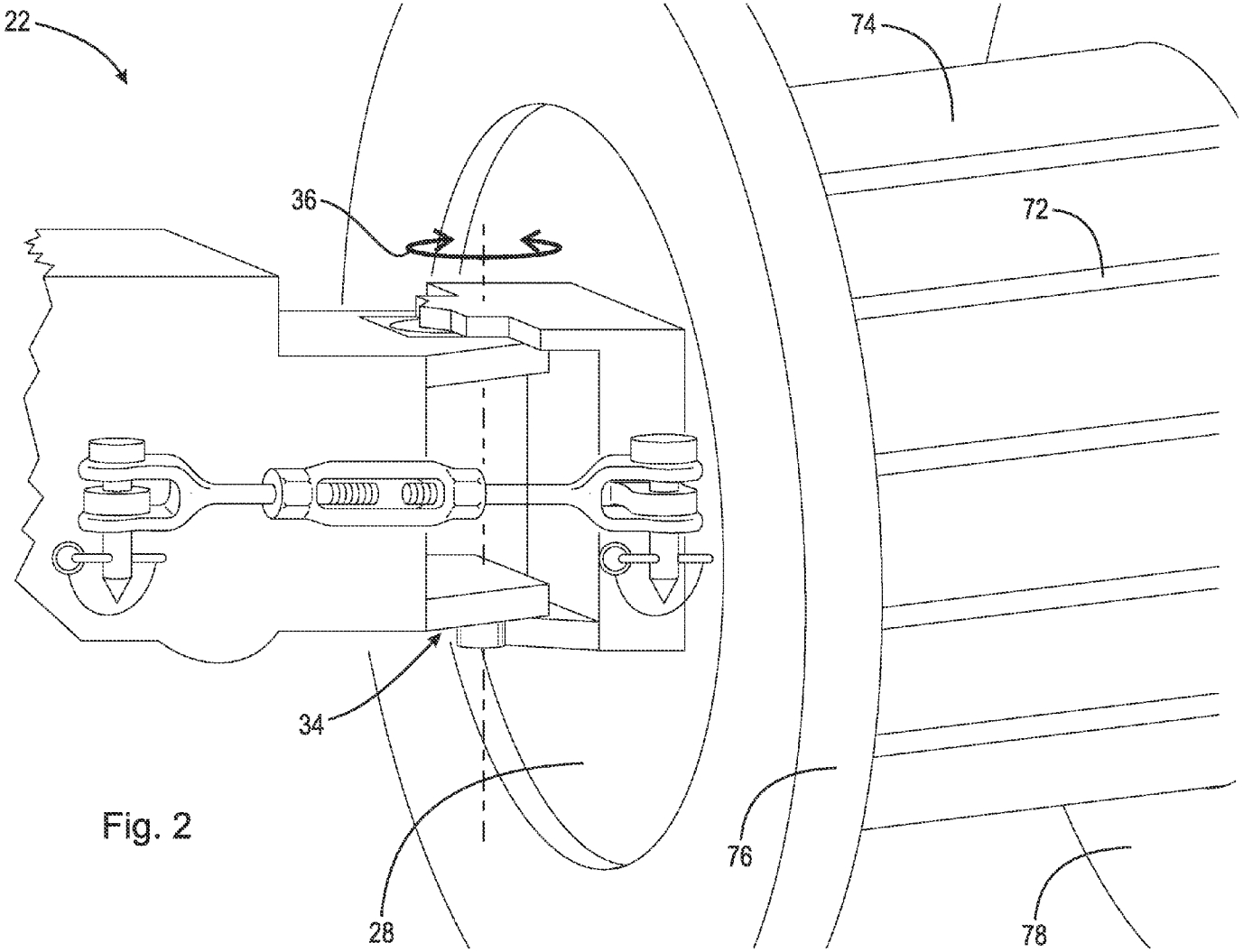
FIG. 2 is an enlarged perspective view of an embodiment of a wheel assembly from the demolition apparatus depicted in FIG. 1.
Figure 3:
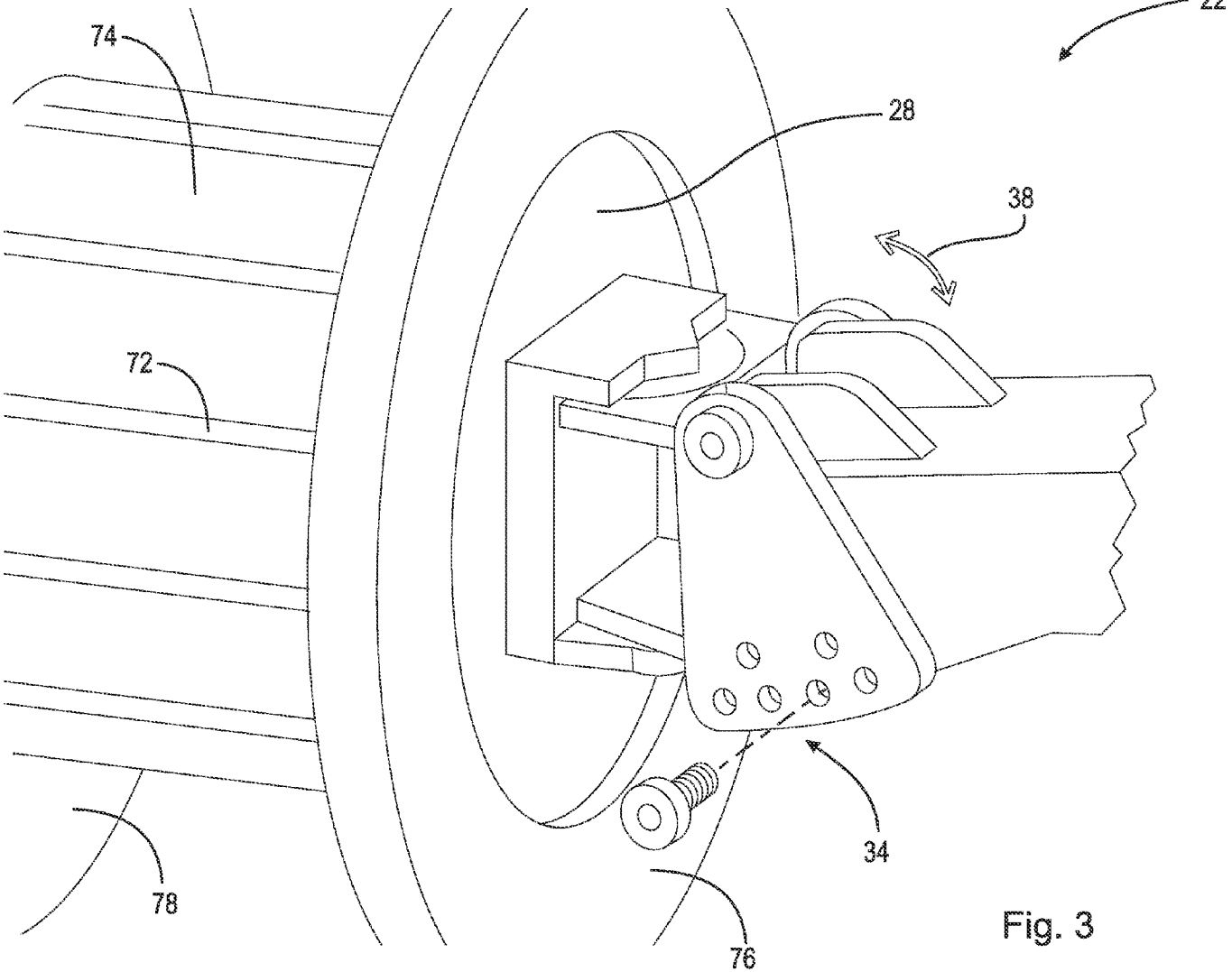
FIG. 3 is an enlarged perspective view of an embodiment of a wheel assembly from the demolition apparatus depicted in FIG. 1.
Figures 4, 5:
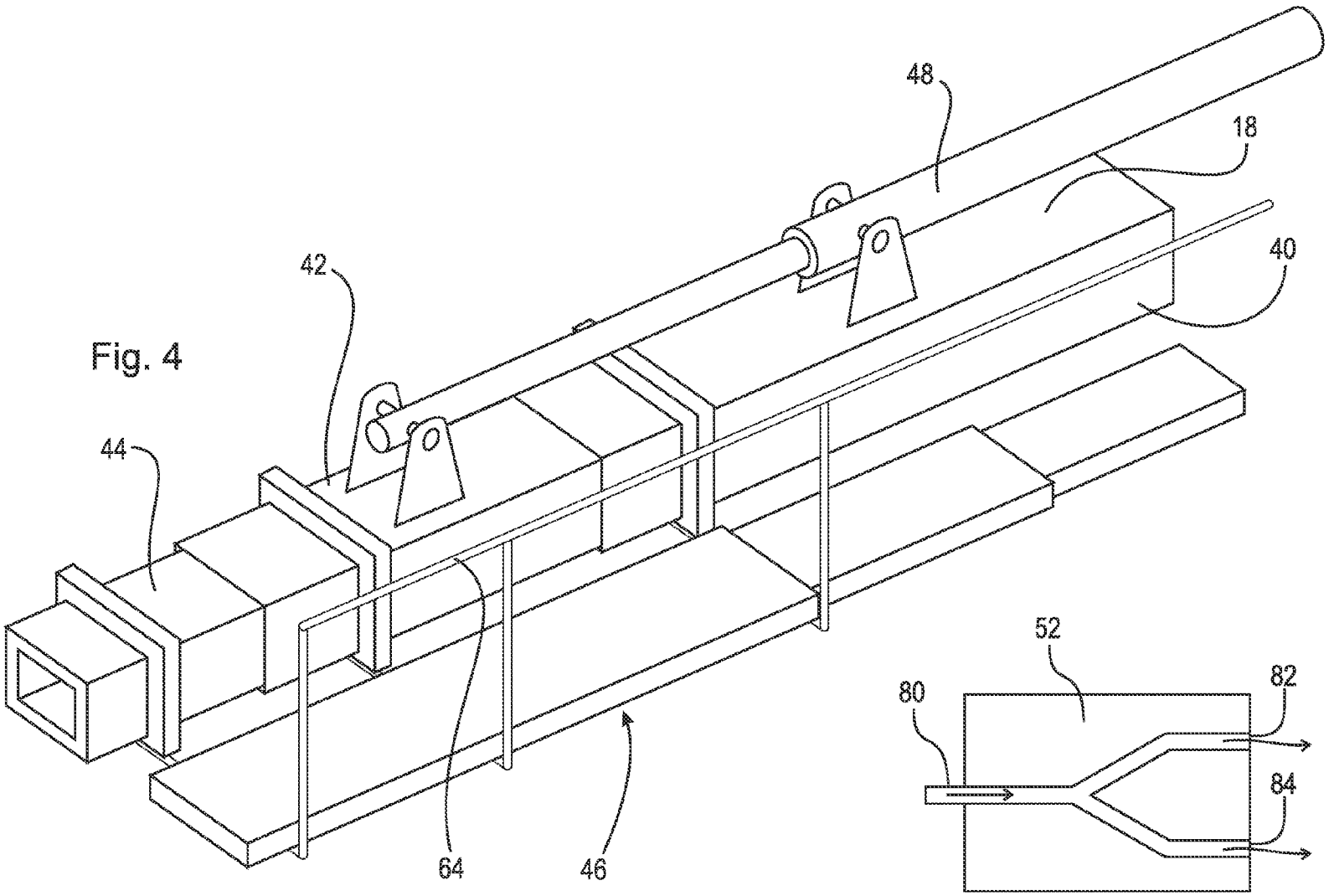
FIG. 4 is a perspective view of an embodiment of a rear telescoping arm from the demolition apparatus depicted in FIG. 1.
FIG. 5 is a schematic depiction of an embodiment of a hydraulic balancing means from a present invention demolition apparatus.

At the outset, it should be appreciated that like drawing numbers on different drawing views identify identical, or functionally similar, structural elements of the invention. While the present invention is described with respect to what is presently considered to be the preferred aspects, it is to be understood that the invention as claimed is not limited to the disclosed aspects.

Furthermore, it is understood that this invention is not limited to the particular methodology, materials and modifications described and as such may, of course, vary. It is also understood that the terminology used herein is for the purpose of describing particular aspects only, and is not intended to limit the scope of the present invention, which is limited only by the appended claims.

Unless defined otherwise, all technical and scientific terms used herein have the same meaning as commonly understood to one of ordinary skill in the art to which this invention belongs. It should be appreciated that the term "balanced" hydraulic systems, e.g., cylinders, motors, etc., are intended to mean the application of pressure, including an initial state and positive and negative changes, occur equally or substantially equally throughout the various "balanced" hydraulic systems. Moreover, it should be appreciated that "fluid communication", as used herein, is intended to mean that one or more systems, e.g., hydraulic systems, are interconnected such that fluid inputs of these systems are connected and share a common pressurized fluid source. Although any methods, devices or materials similar or equivalent to those described herein can be used in the practice or testing of the invention, the preferred methods, devices, and materials are now described.

Adverting now to the figures, the accompanying figure depict the structure and functional arrangement of the present invention demolition apparatus. Demolition apparatus 10 broadly comprises main chassis 12, first and second front arms 14 and 16, respectively, rear telescoping arm 18 and excavator 20. First and second front arms 14 and 16, respectively, are pivotally connected to main chassis 12 and comprise first and second wheel assemblies 22 and 24, respectively. Rear telescoping arm 18 is fixedly connected to main chassis 12 and comprises third wheel assembly 26. Excavator assembly 20 is pivotally connected to main chassis 12. First, second and third wheel assemblies 22, 24 and 26, respectively, comprise first, second and third hydraulic motors 28, 30 and 32, respectively. The first, second and third hydraulic motors are balanced and adapted to rotate the first, second and third wheel assemblies at a common speed. The common speed of rotation ensures that demolition apparatus maintains is position relative to the structure being demolished. In other words, no wheel rotates in such a way as to compromise the safety of the demolition apparatus when in use. In an embodiment, first, second and third hydraulic motors 28, 30 and 32, respectively, are balanced by fluid communication between the first, second and third hydraulic motors 28, 30 and 32, respectively, i.e., the hydraulic inputs for each motor are interconnected and thereby sharing a common source of hydraulic fluid.

In an embodiment, each of first, second and third wheel assemblies 22, 24 and 26, respectively, are attached to first front arm 14, second front arm 16 and rear telescoping arm 18, respectively, via combination yoke and spindle assembly 34, and combination yoke and spindle assembly 34 is adapted to permit movement of the associated wheel assembly in a vertical plane and a horizontal plane, i.e., in the directions depicted by bi-directional arrows 36 and 38, respectively.

In an embodiment, rear telescoping arm 18 further comprises first, second and third boom sections 40, 42 and 44, respectively, and telescoping catwalk assembly 46. First boom section 40 and second boom section 42 are interconnected by first hydraulic cylinder 48, while second boom section 42 and third boom section 44 are interconnected by second hydraulic cylinder 50. First and second hydraulic cylinders 48 and 50, respectively, comprise first and second resistances to movement, respectively. The resistances to movement are a representation of the magnitude of force which must be generated within a hydraulic cylinder in order to effect linear movement, either extension or retraction, of the same. First and second hydraulic cylinders 48 and 50, respectively, are balanced and adapted to selectably extend and retract according to the smaller of the first and second resistances at a time when a pressure change is directed to the first and second cylinders. In other words, as a hydraulic pressure, negative or positive, is applied to the first and second cylinders, the cylinder which is in a state to linearly move with the least pressure is actuated while the other cylinder does not linearly move. It should be appreciated that it is also possible depending on the relative relationship between the resistances to movement that both cylinders may move equally or both cylinders may move but unequally, and such variations fall within the scope of the claims. In an embodiment, first and second hydraulic cylinders 48 and 50, respectively, are balanced by forming a fluid connection between the first and second hydraulic cylinders, e.g., splitter block 52.

In view of the foregoing, it will be advantageous to further describe the structure and function of the present invention demolition apparatus. Demolition apparatus 10 comprises structural steel chassis 12 designed to support the weight and loads imposed upon it during concrete structure, e.g., chimney, demolition, using a manufactured hydraulic excavator with concrete breaking or crushing attachments as required, e.g., excavator assembly 20. Chassis 12 comprises central hub 54, front hydraulically adjustable arms 14 and 16, rear telescoping boom section 18 and hydraulic driven wheel assemblies 22, 24 and 26.

Chassis 12 may also comprise lifting "tee" 54 mounted to central hub 56, along with telescoping catwalk 46 for assess to chassis 12 and central hub 56 while in operation. A manufactured excavator, e.g., excavator assembly 20, mounts to the top of hub assembly 56, and utilizes remote control for operation of the concrete demolition tools as well as the hydraulic functions contained within the chassis and responsible for rotating the wheel assemblies and actuating rear telescoping boom section 18.

Various embodiments of the present invention are designed and constructed for concrete chimneys and other generally circular structures having diameters ranging from approximately thirty-five feet to sixty feet in diameter. It should be appreciated that different diameter ranges can be obtained by varying the dimensions of rear telescoping boom 18, the specifications of hydraulic cylinders 48 and 50, the dimensions of front arms 14 and 16, during design and fabrication of these components.

Front-mounted lifting tee 54 is designed to support the lifting of demolition apparatus 10 into position at the top of a concrete chimney, e.g., chimney 58. Once raised and in position, tee 54 is also used as a support point for the lifting of other equipment, as needed. Tee 54 is removable, if desired, and connects to chassis hub 56 via two high-strength alloy steel pins. While in place, tee 54 protects the front portion of apparatus 10 and attachment points 60 and 62 of front legs/arms 14 and 16 from concrete debris during operation.

In an embodiment, telescoping catwalk 46 comprises aluminum channel sections, i.e., first, second and third boom sections 40, 42 and 44, respectively, of varying dimensions to allow one section to slide within the next. In an embodiment, ball-bearing rollers are utilized to provide smooth operation of catwalk 46 while extending and retracting; however, any means known in the art may be used. In some embodiments, catwalk 46 utilizes telescoping aluminum safety/hand rail assembly 64 that works in similar fashion to the deck assembly described above. In some embodiments, catwalk 46 is mounted to the chassis at four locations along the rear boom assembly, such that it extends and retracts in unison with the rear boom assembly.

In an embodiment, rear telescoping boom assembly 18 comprises three individual rectangular boom sections, e.g., first, second and third boom sections 40, 42 and 44, respectively. A fixed section, e.g., first boom section 40, is rigidly connected to central hub 54 of the chassis 12. The remaining two sections, e.g., second boom section 42 and third boom section 44, are proportioned such that they slide within each other during extending and retracting operations. The extending and retracting of boom assembly 18 is controlled using dual hydraulic cylinders. In an embodiment, one hydraulic cylinder, e.g., first hydraulic cylinder 48, is located at the top of boom assembly 18, while the other hydraulic cylinder, e.g., second hydraulic cylinder 50, is mounted to the bottom of boom assembly 18. The upper cylinder controls the movement of the second or middle boom section, while the lower cylinder controls the movement of the third or last section. Wheel assembly 26 is connected to the third boom section.

As described above, boom section movement between the two cylinders is not independently controlled. The boom sections will extend or retract based upon the cylinder that has the least resistance at the moment hydraulic pressure is fed to the cylinders. This is accomplished by combining the two cylinders with one source via splitter block 52 mounted at the rear of chassis hub 54.

Front arms 14 and 16 are connected at the front of chassis 12 at center hub 54. In an embodiment, arms 14 and 16 are positioned one hundred twenty degrees apart from each other, and one hundred twenty degrees from the centerline of rear boom assembly 18.

In an embodiment, each position of arms 14 and 16 is independently controlled by its own hydraulic cylinder, e.g., cylinders 66 and 68. Arms 14 and 16 can be raised or lowered as required by the operator via remote control (not shown). Yoke/spindle assemblies 34, located at the end of each of arms 14 and 16, provide for the adjustment of wheel angle in both the vertical and horizontal planes. These degrees of freedom are represented by bi-directional arrows 36 and 38.

In an example embodiment, the three wheel assemblies comprise Oerlikon-Fairfield wheel drives with internal brakes, Sauer-Danfoss two speed hydraulic motors and custom steel rims, e.g., rims 70. Rims 70 are equipped with high strength alloy steel wearing teeth 72 welded to wheel hub 74 for traction and durability while driving on concrete walls. The rim width is designed for the specific wall thicknesses to be encountered on a given project. In some embodiments, rims 70 connect to the wheel drive assemblies with lug nuts. Interior and exterior stiffened plates 76 and 78, respectively, are provided to ensure the wheel assemblies remain upon the concrete wall at all times.

Although in an embodiment the present invention is designed to travel primarily in the counter-clockwise direction, the wheel assemblies have the capability of driving in both clockwise and counter-clockwise directions, as required by a particular job needs. Furthermore, in an embodiment, the present invention demolition apparatus may comprise an additional fixed arm disposed between each front arm 14 and 16 and rear telescoping boom 18, thereby providing fourth and fifth arms for the apparatus. Such an arrangement permits the demolition apparatus to be secured in place at the top of the chimney or other structure being demolished without relying upon hydraulic support from front arms 14 and 16. This permits the apparatus to be shut down during periods of non-use, or alternatively, permits the servicing of the front arms as the additional arms receive the full load of the demolition apparatus. The fourth and fifth arms may be permanently installed on the main chassis, retractably installed, releasably secured, or otherwise connected to the main chassis by any means known in the art.

It should be appreciated that hydraulic pressure may be balanced in both cylinders and motors by passing hydraulic input line 80 through splitter block 52 and connecting outputs 82 and 84 to a pair of cylinders or motors. Additionally, splitter block 52 may include more than two outputs, e.g., three or more, where the number of outputs is equal to the number of elements to be hydraulically balanced.

Figure 6:
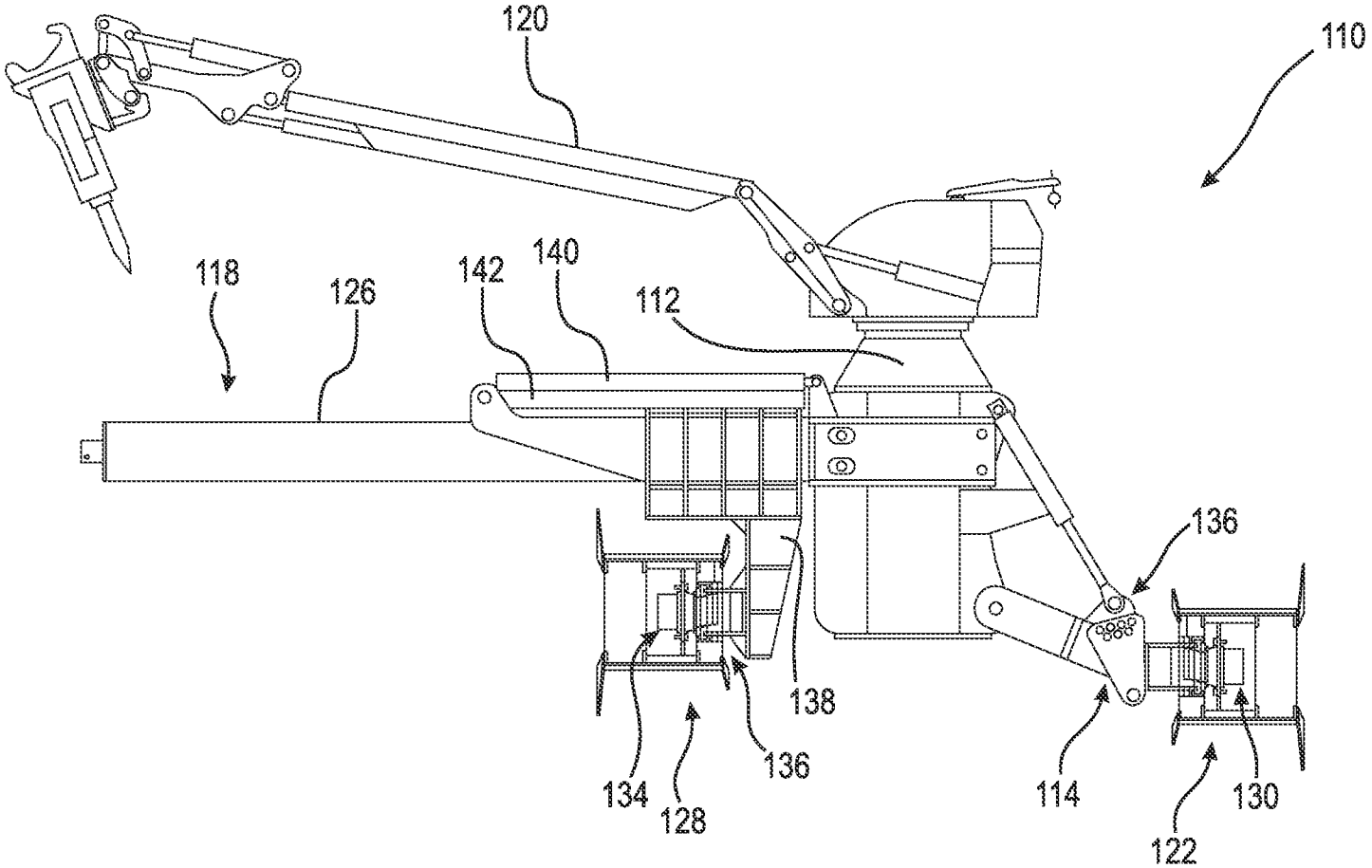
FIG. 6 is a side elevational view of another embodiment of a present invention demolition apparatus having a rear wheel in a retracted position; and, FIG. 7 is a side elevational view of the demolition apparatus depicted in FIG. 6 having the rear wheel in an extended position.
Figure 7:
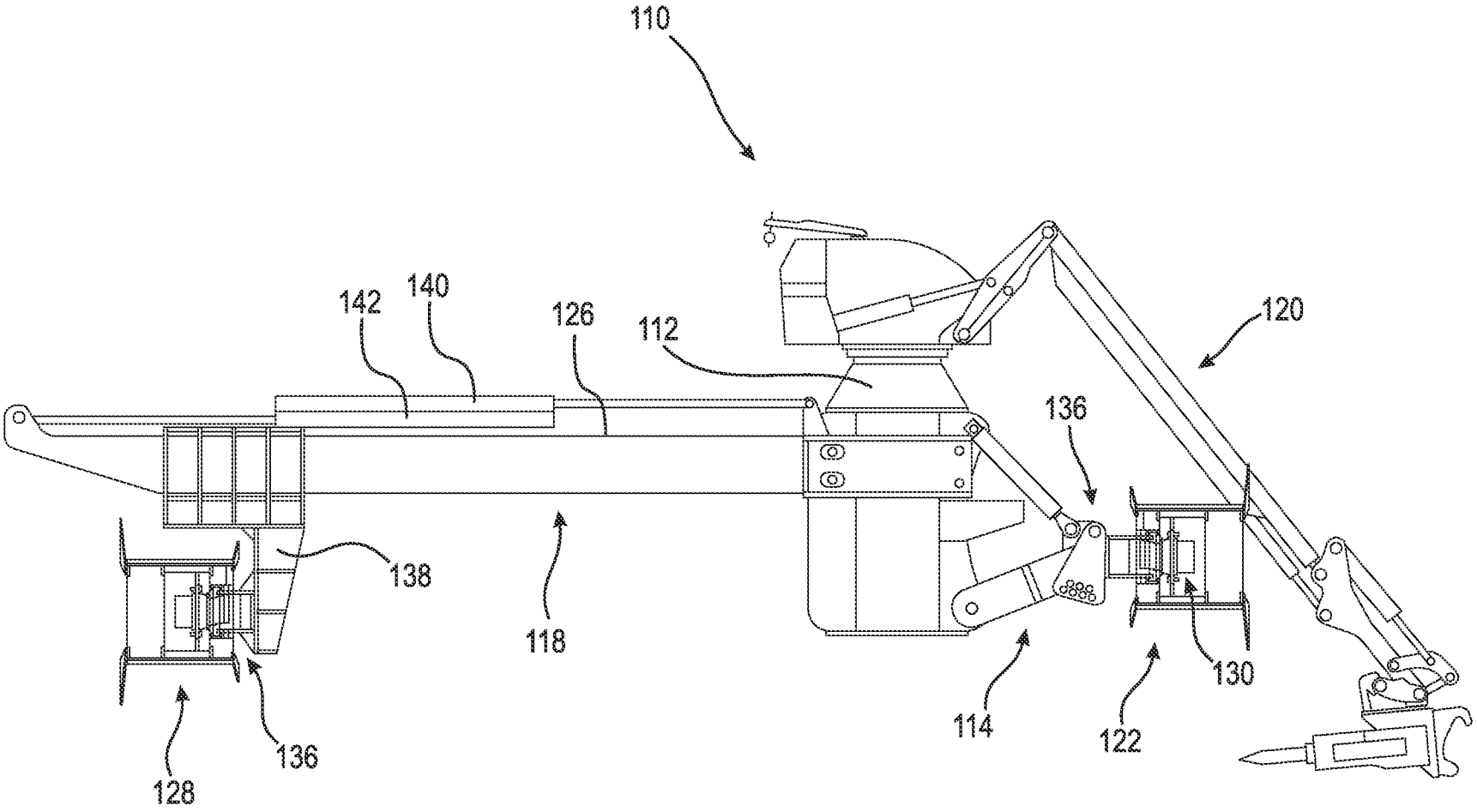

FIGS. 6 and 7 depict another embodiment of the present demolition apparatus. Demolition apparatus 110 comprises main chassis 112, first and second front arms 114 and 116 (not shown), respectively, rear arm 118 and excavator assembly 120. First and second front arms 114 and 116 (not shown), respectively, are pivotally connected to main chassis 112 and comprise first and second wheel assemblies 122 and 124 (not shown), respectively. Rear arm 118 is fixedly connected to main chassis 112 and comprises track 126 and third wheel assembly 128 adapted for displacement within track 126. Excavator assembly 120 is pivotally connected to main chassis 112.

Similar to the embodiments described above, in an embodiment, first, second and third wheel assemblies 122, 124 (not shown) and 128, respectively, comprise first, second and third hydraulic motors 130, 132 (not shown) and 134, respectively. First, second and third hydraulic motors 130, 132 (not shown) and 134, respectively, may be balanced and adapted to rotate first, second and third wheel assemblies 122, 124 (not shown) and 128, respectively, at a common speed. First, second and third hydraulic motors 130, 132 (not shown) and 134, respectively, are balanced by fluid communication between the first, second and third hydraulic motors. Each of the first, second and third wheel assemblies 122, 124 (not shown) and 128, respectively, are attached to first front arm 114, second front arm 116 and rear arm 118, respectively, via combination yoke and spindle assembly 136, and each combination yoke and spindle assembly 136 is adapted to permit movement of a wheel assembly in a vertical plane and a horizontal plane.

Rear arm 118 further comprises wheel mount 138 and first and second hydraulic cylinders 140 and 142, respectively. Third wheel assembly 128 may be rotatably secured to wheel mount 138. First hydraulic cylinder 140 may be connected to main chassis 112 and second hydraulic cylinder 142. Second hydraulic cylinder 142 may be connected to first hydraulic cylinder 140 and wheel mount 138. The first and second hydraulic cylinders comprise first and second resistances to movement, respectively. The first and second hydraulic cylinders are balanced and adapted to selectably extend and retract according to the smaller of the first and second resistances at a time when a pressure change is directed to the first and second cylinders. In an embodiment, the first and second hydraulic cylinders are balanced by forming a fluid connection between the first and second hydraulic cylinders. Third wheel assembly 128 may be adapted for linear displacement within track 126.

The following description of an embodiment of the present invention's operation further clarifies how it accomplishes unmet needs described above. Excavator assembly 20 mounted atop chassis 12 is fitted with a concrete breaking hydraulic hammer or concrete crusher. An operator positions him or herself on a work scaffold at the exterior of the stack or chimney and operates the hydraulic hammer via remote control. The objective is to break the concrete in section having an approximate horizontal dimension of eight feet and an approximate vertical dimension of four to five feet. All breaking is done from the outside-in, allowing the concrete to drop to the interior area of the stack or chimney. Breaking is done between front arms 14 and 16 at all times. Once the limits of the break are complete, the machine is driven in the counter-clockwise direction to a position for the next break series. The foregoing breaking pattern repeats in a spiral fashion as demolition continues, to allow the present invention to drive on a relatively smooth path. In instances of counter-clockwise motion, the leading left-hand front wheel and concrete wall elevation is always higher than the right-hand or trailing wheel, by the approximate height of the panel limits intended, e.g., the limits described above. As the diameter of the concrete chimney increases, the operator activates the rear boom to extend the machine length as required to properly fit on the concrete wall. In addition to extending the boom, the front wheel assemblies require angular adjustment in the horizontal plane, e.g., via turnbuckle adjusters, to track along the stack or chimney radius properly.

Thus, it is seen that the objects of the present invention are efficiently obtained, although modifications and changes to the invention should be readily apparent to those having ordinary skill in the art, which modifications are intended to be within the spirit and scope of the invention as claimed. It also is understood that the foregoing description is illustrative of the present invention and should not be considered as limiting. Therefore, other embodiments of the present invention are possible without departing from the spirit and scope of the present invention.

What I claim is:

1. A demolition apparatus comprising:

a main chassis;

first and second front arms pivotally connected to the main chassis and comprising first and second wheel assemblies, respectively;

a rear telescoping arm fixedly connected to the main chassis and comprising a third wheel assembly; and, an excavator assembly pivotally connected to the main chassis, wherein the first, second and third wheel assemblies comprise first, second and third hydraulic motors, respectively, the first, second and third hydraulic motors are balanced and adapted to rotate the first, second and third wheel assemblies at a common speed.

2. The demolition apparatus of claim 1 wherein the first, second and third hydraulic motors are balanced by fluid communication between the first, second and third hydraulic motors.

3. The demolition apparatus of claim 1 wherein each of the first, second and third wheel assemblies are attached to the first front arm, the second front arm and the rear telescoping arm, respectively, via a combination yoke and spindle assembly, and each combination yoke and spindle assembly is adapted to permit movement of a wheel assembly in a vertical plane and a horizontal plane.

4. The demolition apparatus of claim 1 wherein the rear telescoping arm further comprises first, second and third boom sections and a telescoping catwalk assembly, the first and second boom sections interconnected by a first hydraulic cylinder and the second and third boom sections interconnected by a second hydraulic cylinder, the first and second hydraulic cylinders comprising first and second resistances to movement, respectively, the first and second hydraulic cylinders are balanced and adapted to selectably extend and retract according to the smaller of the first and second resistances at a time when a pressure change is directed to the first and second cylinders.

5. The demolition apparatus of claim 4 wherein the first and second hydraulic cylinders are balanced by forming a fluid connection between the first and second hydraulic cylinders.

6. A demolition apparatus comprising:

a main chassis;

first and second front arms pivotally connected to the main chassis and comprising first and second wheel assemblies, respectively;

a rear telescoping arm fixedly connected to the main chassis and comprising a third wheel assembly and first, second and third boom sections, the first and second boom sections interconnected by a first hydraulic cylinder and the second and third boom sections interconnected by a second hydraulic cylinder, the first and second hydraulic cylinders comprising first and second resistances to movement, respectively;

a telescoping catwalk assembly secured to the rear telescoping arm and adapted to extend and retract synchronously with the rear telescoping arm; and, an excavator assembly pivotally connected to the main chassis, wherein the first and second hydraulic cylinders are balanced and adapted to selectably extend and retract according to the smaller of the first and second resistances at a time when a pressure change is directed to the first and second cylinders.

7. The demolition apparatus of claim 6 wherein the first and second hydraulic cylinders are balanced by forming a fluid connection between the first and second hydraulic cylinders.

8. The demolition apparatus of claim 6 wherein the first, second and third wheel assemblies comprise first, second and third hydraulic motors, respectively, the first, second and third hydraulic motors are balanced and adapted to rotate the first, second and third wheel assemblies at a common speed.

9. The demolition apparatus of claim 8 wherein the first, second and third hydraulic motors are balanced by fluid communication between the first, second and third hydraulic motors.

10. The demolition apparatus of claim 8 wherein each of the first, second and third wheel assemblies are attached to the first front arm, the second front arm and the rear telescoping arm, respectively, via a combination yoke and spindle assembly, and each combination yoke and spindle assembly is adapted to permit movement of a wheel assembly in a vertical plane and a horizontal plane.

11. A demolition apparatus comprising:

a main chassis;

first and second front arms pivotally connected to the main chassis and comprising first and second wheel assemblies, respectively;

a rear telescoping arm fixedly connected to the main chassis and comprising a third wheel assembly, first, second and third boom sections and a telescoping catwalk assembly, the first and second boom sections interconnected by a first hydraulic cylinder and the second and third boom sections interconnected by a second hydraulic cylinder, the first and second hydraulic cylinders comprising first and second resistances to movement, respectively; and, an excavator assembly pivotally connected to the main chassis, wherein the first, second and third wheel assemblies comprise first, second and third hydraulic motors, respectively, the first, second and third hydraulic motors are balanced and adapted to rotate the first, second and third wheel assemblies at a common speed, the first and second hydraulic cylinders are balanced and adapted to selectably extend and retract according to the smaller of the first and second resistances at a time when a pressure change is directed to the first and second cylinders.

12. The demolition apparatus of claim 11 wherein the first, second and third hydraulic motors are balanced by fluid communication between the first, second and third hydraulic motors.

13. The demolition apparatus of claim 11 wherein each of the first, second and third wheel assemblies are attached to the first front arm, the second front arm and the rear telescoping arm, respectively, via a combination yoke and spindle assembly, and each combination yoke and spindle assembly is adapted to permit movement of a wheel assembly in a vertical plane and a horizontal plane.

14. The demolition apparatus of claim 11 wherein the first and second hydraulic cylinders are balanced by forming a fluid connection between the first and second hydraulic cylinders.

15. A demolition apparatus comprising:

a main chassis;

first and second front arms pivotally connected to the main chassis and comprising first and second wheel assemblies, respectively;

a rear arm fixedly connected to the main chassis and comprising a track and a third wheel assembly adapted for displacement within the track; and, an excavator assembly pivotally connected to the main chassis, wherein the first, second and third wheel assemblies comprise first, second and third hydraulic motors, respectively, the first, second and third hydraulic motors are balanced and adapted to rotate the first, second and third wheel assemblies at a common speed.

16. The demolition apparatus of claim 15 wherein the first, second and third hydraulic motors are balanced by fluid communication between the first, second and third hydraulic motors.

17. The demolition apparatus of claim 15 wherein each of the first, second and third wheel assemblies are attached to the first front arm, the second front arm and the rear arm, respectively, via a combination yoke and spindle assembly, and each combination yoke and spindle assembly is adapted to permit movement of a wheel assembly in a vertical plane and a horizontal plane.

18. The demolition apparatus of claim 15 wherein the rear arm further comprises a wheel mount and first and second hydraulic cylinders, the third wheel assembly rotatably secured to the wheel mount, the first hydraulic cylinder connected to the main chassis and the second hydraulic cylinder, the second hydraulic cylinder connected to the first hydraulic cylinder and the wheel mount, the first and second hydraulic cylinders comprising first and second resistances to movement, respectively, the first and second hydraulic cylinders are balanced and adapted to selectably extend and retract according to the smaller of the first and second resistances at a time when a pressure change is directed to the first and second cylinders.

19. The demolition apparatus of claim 18 wherein the first and second hydraulic cylinders are balanced by forming a fluid connection between the first and second hydraulic cylinders.

20. The demolition apparatus of claim 15 wherein the third wheel assembly is adapted for linear displacement within the track.

* * * * *